United States Patent [19]

Ijima

[11] 4,175,888

[45] Nov. 27, 1979

[54] BLOCK FOR CONSTRUCTING BREAKWATER

[75] Inventor: Takeshi Ijima, Fukuoka, Japan

[73] Assignee: Iida Kensetsu Co., Ltd., Fukuoka, Japan

[21] Appl. No.: 914,719

[22] Filed: Jun. 12, 1978

[51] Int. Cl.[2] ..... E02B 3/06

[52] U.S. Cl. ..... 405/31; 52/606; 405/33

[58] Field of Search ..... 61/3, 4, 37; 52/606, 52/607, 596, 603, 604; 405/21, 30, 31, 33, 34

[56] References Cited

U.S. PATENT DOCUMENTS

| | | | |
|---|---|---|---|
| 687,105 | 11/1901 | Anderson | 52/607 X |
| 3,995,434 | 12/1976 | Kato et al. | 61/4 |
| 4,073,145 | 2/1978 | Fair | 61/4 |

*Primary Examiner*—David H. Corbin

*Attorney, Agent, or Firm*—Frank J. Jordan

[57] ABSTRACT

A block of this invention for constructing a breakwater is characterized by having a front wall provided with a horizontal hole, an intermediate wall, a rear wall and a pair of spaced apart longitudinal walls which are disposed perpendicular to the above three walls for integrally connecting the three walls.

Due to such construction, when the blocks are stacked up in rows to form a breakwater, the breakwater can have a first chamber which effects the dissipation of wave force and a second chamber which effects the firm integration of blocks along with the packing of a block uniting material therein.

9 Claims, 8 Drawing Figures

BLOCK FOR CONSTRUCTING BREAKWATER

BACKGROUND OF THE INVENTION

This invention relates to blocks used for constructing a breakwater which can effectively decrease the force of high magnitude waves while maintaining the stability of the structure thereof.

Conventional breakwaters such as caissons are equipped with no provisions for decreasing the wave force. Therefore, the structure which receives all of the wave force inevitably must be extremely large.

Caissons provided with openings have been proposed and developed for replacing such solid caissons. However, these remodelled caissons also have the following problems in view of their construction and installation and therefore few of them have been installed commercially up to this date.

(a) Since such a caisson has holes, the carrier cannot tow the caisson from the manufacturing site to the installation site. Accordingly, the installation operation requires a large-sized carrier vessel equipped with a gigantic crane, which results in expensive installation. Such a disadvantage is especially remarkable in a small-scale installation operation.

(b) Since the caisson which has openings cannot accommodate the packing or charging material, such a caisson is light in weight although the volume thereof is large. Therefore, this caisson lacks resistance against outer forces such as waves or earth pressures.

(c) Standardization of the caissons corresponding to the size of the installation operation is impossible.

(d) Since the caisson is in general large-sized, the manufacturing facilities also must be large in scale. The operation of such facilities is costly.

Accordingly, in recent times, a method to construct breakwaters with blocks has been proposed. In fact, more than 200 breakwaters have been constructed or installed by the above method. However, with regard to the conventional blocks, when they are stacked one on another, they resist the outer force (such as the wave force) only with the weight of the blocks and the frictional resistance between the contact surfaces of the blocks. Therefore, the breakwater structure constructed with such blocks still has problems to be solved in view of its stability.

It is an object of the present invention to provide blocks which can resolve such defects of conventional blocks while fully utilizing the inherent advantages (readiness of installation, handiness, full running of molds).

It is another object of the present invention to provide such blocks, which, when stacked up, can remarkably increase the stability of the structure.

DETAILED DESCRIPTION OF THE DISCLOSURE

Figure 1:
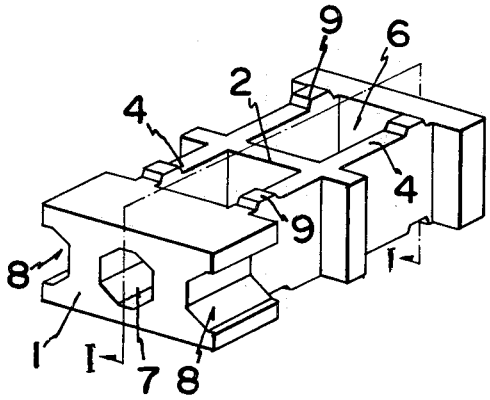
FIG. 1 is a perspective top view of the block of this invention.
Figure 2:
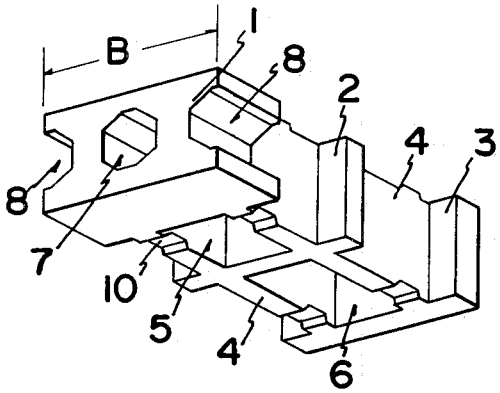
FIG. 2 is a perspective bottom view of the above block.
Figure 3:
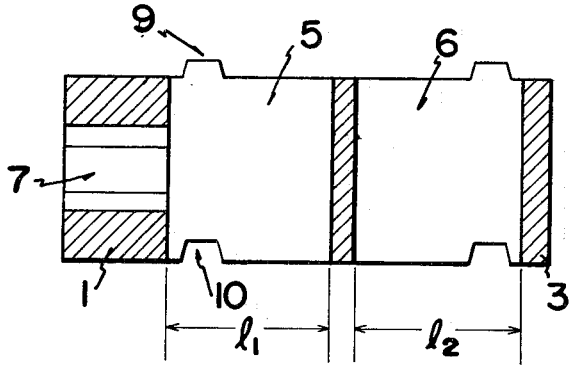
FIG. 3 is a longitudinal cross sectional view taken along the line I—I of FIG. 1.

The construction of the block of this invention is hereinafter disclosed.

In the drawings, three walls, namely a front wall 1, an intermediate wall 2 and a rear wall 3 are disposed in a parallel and spaced-apart relationship. Those three walls are jointed by two parallel and spaced-apart partition walls 4 which are arranged perpendicularly to the former three walls 1, 2 and 3. Between the front wall 1 and the intermediate wall 2, a first vertically-open-ended chamber 5 is formed while a second vertically open-ended chamber 6 is formed between the intermediate wall 2 and the rear wall 3.

A horizontal hole 7 is formed in the central portion of the front wall 1 such that the incident wave passes therethrough and enters into the first chamber 5.

Figure 5:
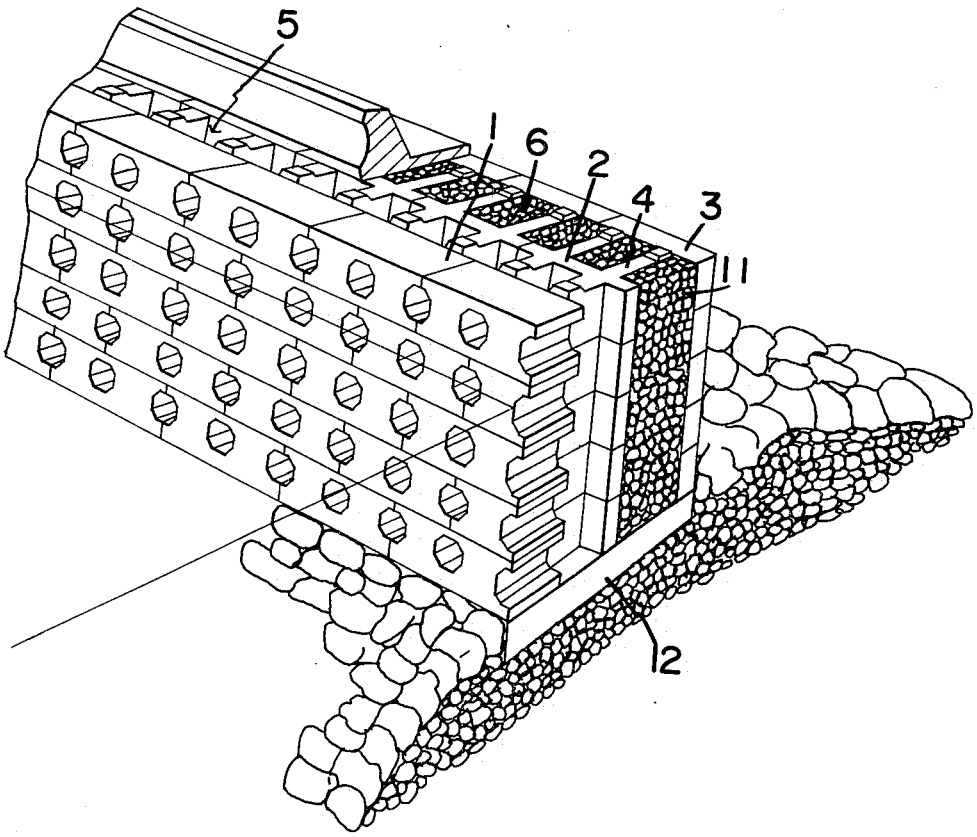
FIG. 5 is a perspective view showing a breakwater constructed by the above blocks.
Figure 6:
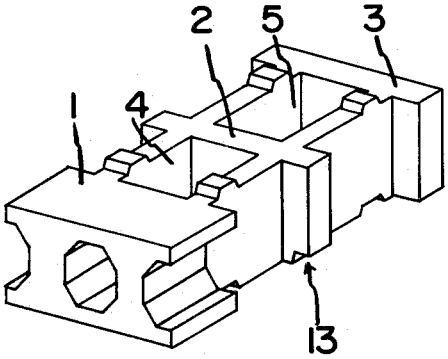
FIG. 6 is a perspective top view of another block of this invention.
Figure 7:
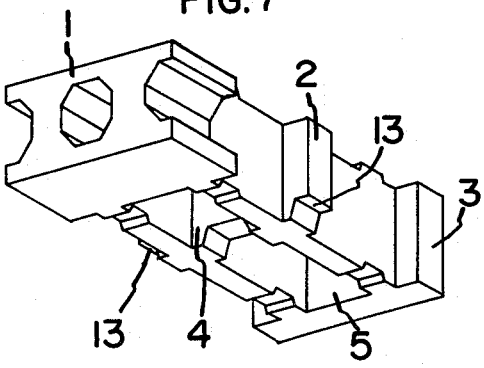
FIG. 7 is a perspective bottom view of the above block.
Figure 8:
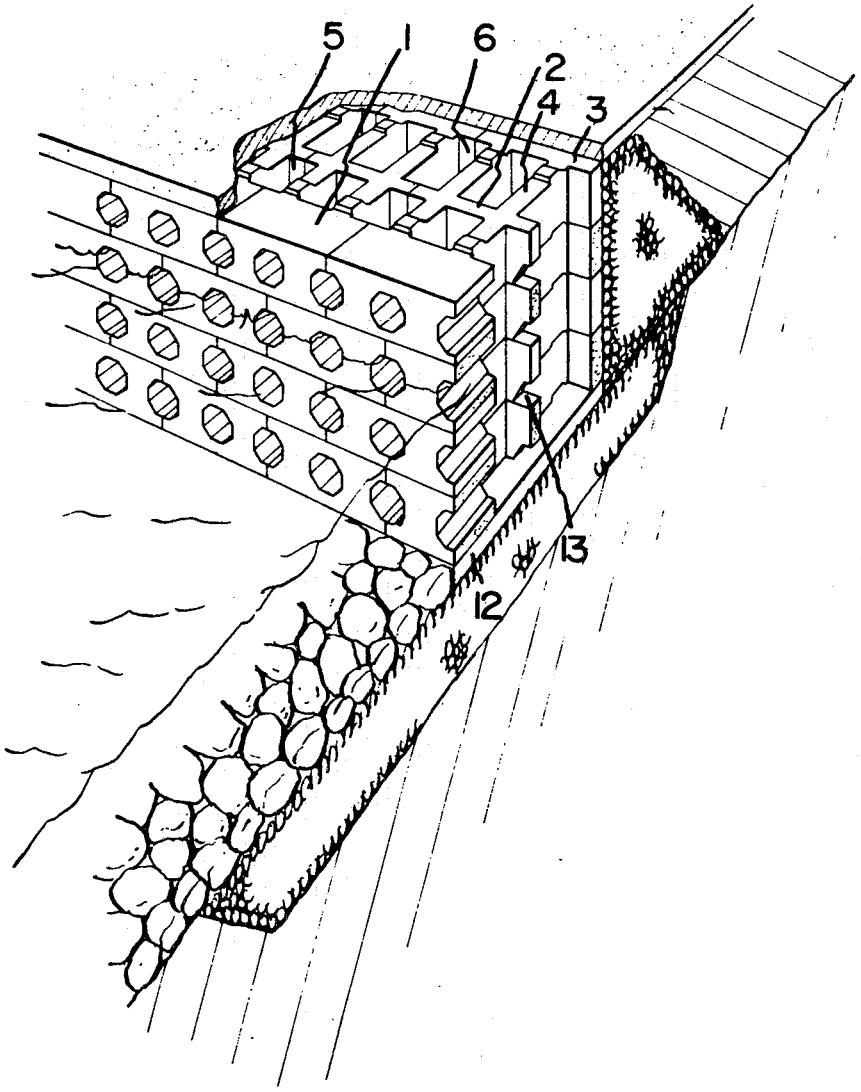
FIG. 8 is a perspective view of a breakwater constructed by the above blocks.

Numeral 8 indicates cut-out portions provided at both sides of the front wall 1. The cross-section of each cut-out portion 8 is equal to half of the cross-section of the horizontal opening 7 so that when the blocks are arranged laterally as shown in FIG. 5, a pair of cut-out portions 8, form a horizontal opening equivalent to the horizontal opening 7.

The block of this invention is further provided with a means for facilitating the stacking-up of blocks. Such means consist of a retaining protrusion 9 formed at the upper end of the partition plate 4 and a recess 10 formed at the lower end of the partition plate 4. By engaging the protrusion 9 with the recess 10, the blocks can be readily and accurately stacked up on one another.

Numeral 11 indicates a block uniting material (bulk of gravel) which can promote the integrity of the structure made by the blocks. Although a bulk of gravel is employed as such material in the attached drawings, other charging materials such as prepacked concrete can be used. Numeral 12 indicates a horizontal base plate which supports the structure on the sea bed.

Referring now to the preferred feature of the parts of the block, the total of the cross-sectional area of the horizontal opening 7 and the cut-out portions should preferably account for about 25 to 35 percent of the total area of the front wall 1. The distance $l_1$ of the first chamber should preferably be 2 to 8 percent of the incident wave length L for efficiently lowering the wave force, while the distance $l_2$ of the second chamber must be determined in view of the total weight (volume) of the block uniting material 11 to be charged therein. Furthermore, the partition wall should preferably be arranged such that each wall connects the portions of the respective walls 1, 2 and 3 which are disposed $\frac{1}{4}$ B (width of the block) away from either side of respective walls 1, 2 and 3.

The manner for constructing a breakwater of the present invention is described hereinafter. First, a breakwater base including a horizontal base plate 12 is constructed on the water bed and a series of blocks which forms the first row of blocks are mounted on said base plate 12 such that the front wall 1 of the blocks faces out to the sea. Thereafter, the subsequent rows of blocks including the second row are stacked one on another in a staggered or zigzag pattern. (Of course, it does not necessarily need to become a staggered zigzag pattern and the blocks may be stacked aligning the side lines of all blocks on the same vertical line.)

In this embodiment, the stacking operation is carried out steadily and readily due to the provision of each block which consists of the retaining protrusion 9 and the retaining recess 10. In this manner, the desired number of rows of blocks are stacked until a breakwater of a desired height is constructed.

Finally, the block-uniting material 11 (for example, gravel) is charged into the inside of the second chamber 6 and the construction of the breakwater is completed. As mentioned above, since each partition wall 4 of the blocks connects portions of respective walls 1, 2 and 3 which are disposed ¼ B (width of block) away from either side of the respective walls, second chambers 6 of the same space can be formed in a vertical direction as well as a widthwise direction even if the blocks are stacked in a staggered or zigzag pattern. Accordingly, along with the charging of gravel into the chamber 6, the blocks are integrally formed into the firm structure due to the friction resistance of gravel which works in a vertical direction as well as a horizontal direction.

Furthermore, gravel shows the friction coefficient of 0.8 when the blocks receive an outer force such as a wave. This value makes a contrast to a friction coefficient of 0.5 of the usual concrete blocks. The ratio of the above two coefficients is 1:1.6 and therefore the structure can increase the stability thereof by 60 percent.

Since the conventional breakwater made by blocks is entirely of a concrete construction, only 50 percent of the weight of the structure can be used as resistance against the outer force in the stability computation of the structure. Whereas, in this invention, it is apparent that about 70 to 80 percent of the weight of the structure can be employed as such resistance. Furthermore, since gravel is inexpensive compared to concrete, the structure can be constructed cheaply.

Moreover, the breakwater constructed by the blocks of the present invention can remarkably reduce the wave force and thereby promote the stability of the structure.

Furthermore, since the block of this invention can show the high wave force dissipation effect with minimum cross-sectional area, the structure can be constructed economically.

Figure 4:
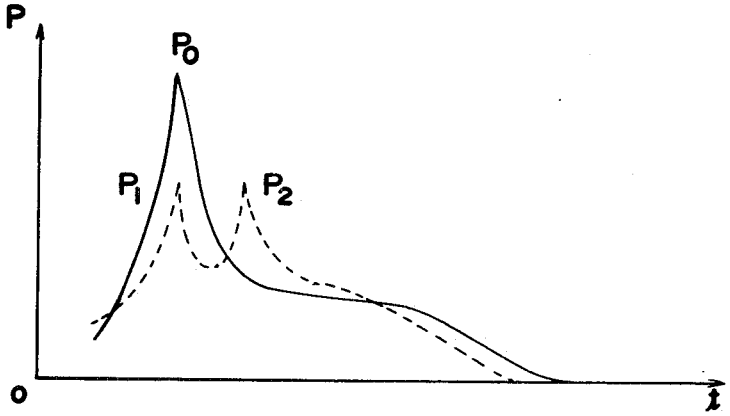
FIG. 4 is a chart showing the relationship between the total horizontal pressure and time.

Generally, as shown in FIG. 4, when the wave hits the conventional structure, the horizontal pressure of the wave (shown by the solid line) rapidly increases as soon as the wave hits the structure and soon reaches the maximum value $P_0$, and immediately and rapidly decreases. After the rapid decrease, the horizontal pressure gradually disappears. Therefore, the structure should be large enough to withstand the maximum horizontal pressure $P_0$.

According to the present invention, the wave first hits the front wall 1. The maximum horizontal pressure $P_1$ at this time is less than $P_0$ since the front wall 1 is provided with both open-ended hole 7. The wave, weakened after hitting and passing through the both open-ended hole 7 secondly hits the intermediate wall 2. The horizontal pressure $P_2$ is also less than $P_0$. In other words, $P_0$ is distributed to $P_1$ and $P_2$. Accordingly, if the ratio of the cross sectional area of the hole 7 as well as the distance $l_1$ between the front wall 1 and the intermediate wall 2 are set within the aforementioned range, $P_0$ could be evenly distributed into $P_1$ and $P_2$. Furthermore, the value of $P_1$ and $P_2$ (horizontal pressure) per se could become less. In fact, the horizontal pressure that the breakwater of this invention receives, can be ½–¼ of the pressure received by the conventional type of breakwater by making the ratio of the cross sectional area of the horizontal hole 7 at 25–35 percent of the total area of the front wall 1 and $l_1$ at 2/100–8/100 of the incident wave length. In view of the above, the block of this invention shows a highly improved effect on lowering wave pressure.

As discussed above, the block according to the present invention is mainly used for constructing a breakwater. However, the block is also applicable to the quay in the harbor where calm water is required, since the block can absorb the reflected wave.

In such a case, the intermediate wall 2 is provided with holes 13 having the cross sectional area ⅓–¼ of the cross sectional area of the holes 7 of the front wall 1. Through the holes 13, sea water is charged into the second chamber 6 from the first chamber 5. It is needless to say that no block uniting material is filled up in the second chamber 6 of this modified block.

As has been described heretofore, the block according to the present invention has the following advantages.

(1) The shape and the construction of the block are so simple that the manufacture and installation are conducted easily. Accordingly, the construction period is shortened as well as the overall economic advantage is obtained.

(2) Since the overall weight of the structure constructed by the blocks according to the present invention is much smaller than the weight of the structure formed by conventional type blocks, such blocks are applicable to the site where a firm base cannot be obtained.

(3) Due to the block uniting material in the second chamber, not only the frictional resistance between the contacting surfaces of blocks but also the frictional resistance of the gravel are employed as the resistance against wave force. Therefore, the breakwater structure formed by the blocks of this invention becomes extremely stable.

What we claim is:

1. A block for constructing a breakwater comprising:

a front wall, an intermediate wall disposed in parallel and spaced-apart relationship relative to said front wall, a rear wall disposed in parallel and spaced-apart relationship relative to said intermediate wall, a pair of parallel and spaced-apart partition walls, said partition walls being disposed perpendicularly to said front, intermediate, and rear walls and integrally connecting said three walls to form a first vertical open-ended chamber between said front and intermediate walls and a second vertical open-ended chamber between said intermediate and rear walls, said front wall having a horizontal hole disposed in the central portion thereof for introducing water into said first chamber, said front wall also having cut-out portions disposed at both sides thereof, each of said cut-out portions having a cross-sectional area substantially equal to one-half of the cross-sectional area of said horizontal hole, said horizontal hole and said cut-out portions constituting 25 to 35 percent of the total area of said front wall, whereby water passing through said horizontal hole and cut-outs serve to alleviate the impulse pressure received by the breakwater.

2. A block for constructing a breakwater according to claim 1, wherein the distance between said front and intermediate walls is about 2 to 8 percent of the incident wave length.

3. A block for constructing a breakwater according to claim 1, wherein a filler material is adapted to be disposed in said second chamber, and the distance between said intermediate and rear walls is determined by the type of filler material disposed in said second chamber.

4. A block for constructing a breakwater according to claim 1, wherein at least one horizontal cut-out portion is formed in said intermediate wall for communicating said first chamber with said second chamber.

5. A block for constructing a breakwater according to claim 1, further comprising protrusions and recesses on said block with the protrusions of each block being adapted to water with the recesses of a mating like block to thereby facilitate stacking of the blocks.

6. A breakwater comprising:

a plurality of blocks, each of said blocks comprising:

a front wall, an intermediate wall disposed in parallel and spaced-apart relationship relative to said front wall, a rear wall disposed in parallel and spaced-apart relationship relative to said intermediate wall, a pair of parallel and spaced-apart partition walls, said partition walls being disposed perpendicular to said front, intermediate, and rear walls and integrally connecting said three walls to form a first vertical open-ended chamber between said front and intermediate walls and a second vertical open-ended chamber between said intermediate and rear walls, said front wall having a horizontal hole disposed in the central portion thereof for introducing water into said first chamber, said front wall also having cut-out portions disposed at both sides thereof, each of said cut-out portions having a cross-sectional area substantially equal to one-half of the cross-sectional area of said horizontal hole, said plurality of blocks being mated in juxtaposed array such that the cut-out portions of juxtaposed blocks are mated to define horizontal openings in the breakwater, said horizontal openings having a cross-sectional area substantially equal to the cross-sectional area of said horizontal hole in each block, said horizontal holes and said horizontal openings constituting 25 to 35 percent of the total area of said breakwater, whereby water passing through said horizontal holes and openings serve to alleviate the impulse pressure received by the breakwater.

7. A breakwater according to claim 6, wherein each of said blocks have at least one protrusion and at least one recess with the protrusion of one block mating with the recess of a juxtaposed mating block to thereby facilitate stacking of the blocks.

8. A breakwater according to claim 6 further comprising a filler in at least some of said second chambers.

9. A breakwater according to claim 8, wherein said filler is gravel.

* * * * *